US008294009B2

(12) United States Patent
Muramatsu et al.

(10) Patent No.: US 8,294,009 B2
(45) Date of Patent: Oct. 23, 2012

(54) UPRIGHT PIANO TYPE ACTION

(75) Inventors: Shigeru Muramatsu, Hamamatsu (JP); Hisashi Takeyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/051,934

(22) Filed: Mar. 18, 2011

(65) Prior Publication Data

US 2011/0232457 A1 Sep. 29, 2011

(30) Foreign Application Priority Data

Mar. 25, 2010 (JP) ..... 2010-70523

(51) Int. Cl.
*G10C 3/18* (2006.01)

(52) U.S. Cl. ..... 84/240

(58) Field of Classification Search ..... None
See application file for complete search history.

(56) References Cited

U.S. PATENT DOCUMENTS

| | | | | | |
|---|---|---|---|---|---|
| 2,844,984 | A | * | 7/1958 | Dasenbrook et al. | 84/240 |
| 4,119,008 | A | * | 10/1978 | Kimble | 84/242 |
| 4,840,101 | A | * | 6/1989 | Kummer | 84/247 |
| 4,896,577 | A | * | 1/1990 | Trivelas et al. | 84/240 |
| 5,042,354 | A | * | 8/1991 | Trivelas et al. | 84/240 |
| 5,196,638 | A | * | 3/1993 | Hayashida et al. | 84/240 |
| 5,287,787 | A | * | 2/1994 | Inoue | 84/240 |
| 5,353,671 | A | * | 10/1994 | Inoue et al. | 84/236 |
| 2006/0201308 | A1 | * | 9/2006 | Tanaka | 84/236 |
| 2011/0232457 | A1 | * | 9/2011 | Muramatsu et al. | 84/241 |

FOREIGN PATENT DOCUMENTS

| | | | |
|---|---|---|---|
| EP | 0 585 798 | A2 | 3/1994 |
| EP | 0 585 798 | A3 | 3/1994 |
| EP | 1 701 335 | A1 | 9/2006 |
| FR | 2 652 186 | A1 | 3/1991 |
| FR | 2 679 688 | A1 | 1/1993 |
| GB | 11887 | | 0/1911 |
| GB | 2 256 522 | A | 12/1992 |
| JP | 62-043349 | Y2 | 11/1987 |

OTHER PUBLICATIONS

European Search Report mailed Jul. 9, 2012, for EP Patent Application No. 11157417.4, eight pages.

* cited by examiner

*Primary Examiner* — David Warren
*Assistant Examiner* — Robert W Horn
(74) *Attorney, Agent, or Firm* — Morrison & Foerster LLP

(57) ABSTRACT

A surface 60 of a butt 50 has a flat portion 61 which is situated forward and has a small inclination angle and a slanting pressure receiving portion 62 which is situated backward and has a large inclination angle as areas pushed up by a jack 40. Between the flat portion 61 and the slanting pressure receiving portion 62, an escapement portion 63 having an obtuse angle is formed. The escapement portion 63 is provided to correspond to a position of the jack 40 placed immediately after the start of swinging of the jack 40. The inclination angle of the slanting pressure receiving portion 62 is determined such that in a stage where a key starts returning from a slow full stroke key-depression, a position at which the butt 50 is in contact with the jack 40 is maintained with the butt 50 swinging backward.

6 Claims, 8 Drawing Sheets

UPRIGHT PIANO TYPE ACTION

BACKGROUND OF THE INVENTION

1. Field of the Invention

The present invention relates to an upright piano type action which includes an action for an upright piano and an action of the same type as the action for an upright piano.

2. Description of the Related Art

A conventional action of an upright piano is designed, in order to allow a hammer to hit a string, such that a jack which operates in response to a depression of a key pushes up a surface of a butt to make the hammer supported by the butt swing (e.g., Japanese examined utility model publication No. 62-43349).

Hereafter, the direction in which the hammer (or a swinging member) swinging back and forth moves when a key is depressed is referred to as forward, whereas the direction in which the hammer moves when the key is released is referred to as backward.

The butt, which has a butt main body formed of a plate member supported via a butt flange by a center rail so that the butt can swing, is designed such that a back surface of the butt is pushed up by the jack to swing. The surface which the jack pushes is covered with a butt skin. Between the butt main body and the butt skin, an under cloth and an under felt are sandwiched such that the under cloth and the under felt are arranged in the direction in which the butt is pushed up as described below.

In a state where the key is not depressed, more specifically, the lower end surface of the butt is horizontal or slightly descends backward. On the lower end surface, the under cloth is adhered. The butt also has an inclined surface which extends from the back end of the lower end surface to ascend backward. On the inclined surface, the under felt is adhered. The inclined surface is connected to an upper surface which is not covered with the under felt. The upper surface extends over a step which is equivalent to the thickness of the under felt so that the upper surface connects almost smoothly to the surface of the under felt. The butt skin covers the under cloth and the under felt, being directly adhered to the upper surface.

The jack, which is supported via a jack flange by a wippen so that the jack can swing, is lifted along with the wippen in response to a depression of the key. At a position where the jack has been lifted to some extent, a jack's protruding portion placed backward comes into contact with a regulating button, so that the jack starts swinging backward to rise to the neighborhood of the utmost point to allow an escapement mechanism of the hammer to work. By the contact with the regulating button, more specifically, the jack starts swinging backward, so that the jack moves away from the butt with a tip of the jack being in contact with the butt. By such move of the jack, the jack abruptly reduces the strength by which the jack pushes up the butt. As a result, the resistance to the key-depression perceived by a player sharply reduces to allow the player realize the sense of escapement. Furthermore, when the jack swings backward to enter the neighborhood of the utmost point, the jack loses the function of pushing up the butt. As a result, the escapement mechanism of the hammer acts. Only by an inertial force, in other words, the hammer swings to a point at which the hammer hits the string. Because of the escapement mechanism, the hammer is able to return backward by use of the reaction force produced by the hitting of the string.

The butt is designed to allow the jack to act in such a manner. The area where the under cloth is adhered on the butt corresponds to an area where the tip of the jack is in contact since the jack has been lifted by the depression of the key until the contact with the regulating button. The area where the under felt is adhered corresponds to an area where the jack operates to lose the function of pushing up performed by the tip of the jack after the jack comes into contact with the regulating button to start swinging. In the area where the butt skin is adhered directly to the butt main body, the tip of the jack which no longer has the function of pushing up the butt is in contact with the butt.

Such a configuration of the butt acts as follows. Because the under cloth is provided in the area which comes into contact with the jack immediately after the start of the lifting of the jack, the under cloth serves as a cushion against the contact with the jack. The under felt makes it easy for the tip of the jack to dig into the butt because of the flexibility of the felt. By ascending in the state where the tip of the jack digs into the under felt, the jack performs the function of pushing up the butt. As a result, if the player slightly returns the key from the full stroke position to depress the key in a state where the tip of the jack has descended to the central part of the area where the under felt is adhered, the jack is able to push up the butt. Therefore, the action having such a configuration allows iterated depressions of the key at positions where the key has returned to some extent from the full stroke position. The area where the butt skin is adhered directly to the butt serves to reduce friction resistance between the jack and the butt when the key-depression has developed to the neighborhood of the full stroke position. When the jack reaches this area, the jack smoothly escapes from the butt, resulting in favorable touch perceived by the player at the time of key-depression. In the upper part of the area where the under felt is adhered and in the area where the butt skin is directly adhered, however, the jack will not perform the function of pushing up the butt even if the jack repeatedly moves up and down.

SUMMARY OF THE INVENTION

At the transition point from the under cloth part to the under felt part, as described above, the inclination angle varies in the upright direction. In addition, the transition point approximately corresponds to the position at which the jack comes into contact with the regulating button to start swinging backward. More specifically, the transition point corresponds to a point where the player perceives the sense of escapement. The sense of escapement plays quite an important role in providing the player with the sense of touch which shows the player that the key-depression has reached a depth which is required to generate a musical tone. However, the conventional action of an upright piano offers unclear sense of escapement due to the flexibility of the under felt, impairing the sense of touch.

In addition, even if the player slightly returns the key after the full stroke, the hammer of the key is not able to hit the string as long as the jack is situated in the upper part of the under felt area or in the area where the butt skin is directly adhered. In order to allow the next hitting of the string, the player has to return the key until the jack is situated under the central part of the under felt area. Resultantly, the conventional action is not able to allow repeated key-depressions each of which is depressed at a deep position. In other words, the conventional action is not able to allow repeated weak key-depressions by which the key is slightly moved up and down repeatedly.

An action of a grand piano is configured such that a repetition lever supported by a wippen is provided whereas a jack lifts a hammer roller situated at the neighborhood of the root of a hammer. The repetition lever supports the hammer roller from bellow immediately after hitting of a string. While the hammer roller is supported by the repetition lever, the jack returns to the position situated immediately below the hammer roller to allow the next depression of the key. Therefore, the action of a grand piano allows repeated key-depressions which are depressed at deep positions. In addition, because the repetition lever ensures repeated key-depressions, the jack swings in response to the contact of the jack with a regulating button, so that the tip of the jack is released from the hammer roller. By such a configuration, the action of the grand piano provides the player with clear sense of escapement at the time of key-depression.

The present invention was accomplished to solve the above-described problems of the upright piano type action, and an object thereof is to provide an upright piano type action which offers the sense of touch which is equivalent to that offered by a grand piano by providing the player with clear sense of escapement at the time of key-depression and facilitating repeated key-depressions which are depressed at deep positions.

In order to achieve the above-described object, the present invention provides an upright piano type action including a jack moving in response to a depression and a release of a key; a butt having a surface pushed up by the jack in response to the depression of the key; and a swinging member extending from the butt and swinging forward and backward in response to the depression and the release of the key respectively to perform a hitting activity; wherein the surface of the butt is provided with a flat portion which is situated forward and has a small inclination angle with respect to a horizontal plane, and a slanting pressure receiving portion which is situated backward and has a large inclination angle with respect to the horizontal plane as areas pushed up by the jack, so that the flat portion and the slanting pressure receiving portion form an escapement portion having an obtuse angle between the flat portion and the slanting pressure receiving portion; the escapement portion is provided to correspond to a position of the jack placed immediately after start of swinging caused by contact of the jack with a regulating member in some point during the depression of the key; and the angle of inclination of the slanting pressure receiving portion is determined such that when the key is depressed to a full stroke position so slowly that the swinging member will not perform the hitting activity, the jack is to continue pushing up the butt whereas in a stage where the key starts returning from the full stroke position, a position at which the butt is in contact with the jack is to be kept with the butt swinging backward.

The upright piano type action according to the present invention having such a configuration has an operational advantage as described below. The butt's surface which is pushed up by the jack is designed to transfer from the flat portion having a small inclination angle with respect to the horizontal plane to the slanting pressure receiving portion having a large inclination angle through the escapement portion having an obtuse angle. In addition, the escapement portion is provided to correspond to the position of the jack placed immediately after the start of swinging caused by the contact of the jack with the regulating member. In response to a depression of the key, therefore, the jack swings by the contact with the regulating member, so that the position of the tip of the jack which is in contact with the surface of the butt moves from the flat portion to the slanting pressure receiving portion. At the escapement portion, more specifically, the position of the tip of the jack which is in contact with the surface of the butt transfers from the portion having the small inclination angle with respect to the horizontal plane to the portion having the large inclination angle. Because of the transfer, the upright piano type action of the present invention provides a player with clear sense of escapement which makes the player recognize that the strength required for the key-depression decreases sharply.

The angle of inclination of the slanting pressure receiving portion is determined such that when the key is depressed to a full stroke position so slowly that the swinging member will not perform the hitting activity, the jack is to continue pushing up the butt whereas in a stage where the key starts returning from the full stroke position, a position at which the butt is in contact with the jack is to be kept with the butt swinging backward.

At the time of a key-depression which results in the hitting activity, therefore, a full stroke key-depression makes the jack push up the butt, so that the escapement of the swinging member results in the hitting activity. By the hitting activity, a musical tone is emitted by the hitting of a string or the sensing. When the key is slightly returned from the full stroke position, the jack moves back while the butt swings backward with the position at which the butt is in contact with the jack being maintained. Therefore, a repeated key-depression at this position results in the hitting activity to emit a musical tone. In other words, the upright piano type action of the present invention enables emission of a musical tone by a key-depression at a deep position where the key has been slightly returned from a preceding key-depression. In spite of the upright piano type action, therefore, the action of the present invention enables rapidly repeated weak depressions of the key which is a feature of an action of a grand piano.

As described above, the upright piano type action of the present invention offers the player the sense of touch which is equivalent to that offered by a grand piano by providing the player with clear sense of escapement at the time of key-depression and facilitating repeated key-depressions which are depressed at deep positions.

DESCRIPTION OF THE PREFERRED EMBODIMENT

An embodiment of the present invention will now be described with reference to the drawings. In these figures, identical or similar components are given the same numbers to omit their explanations.

Figure 1:
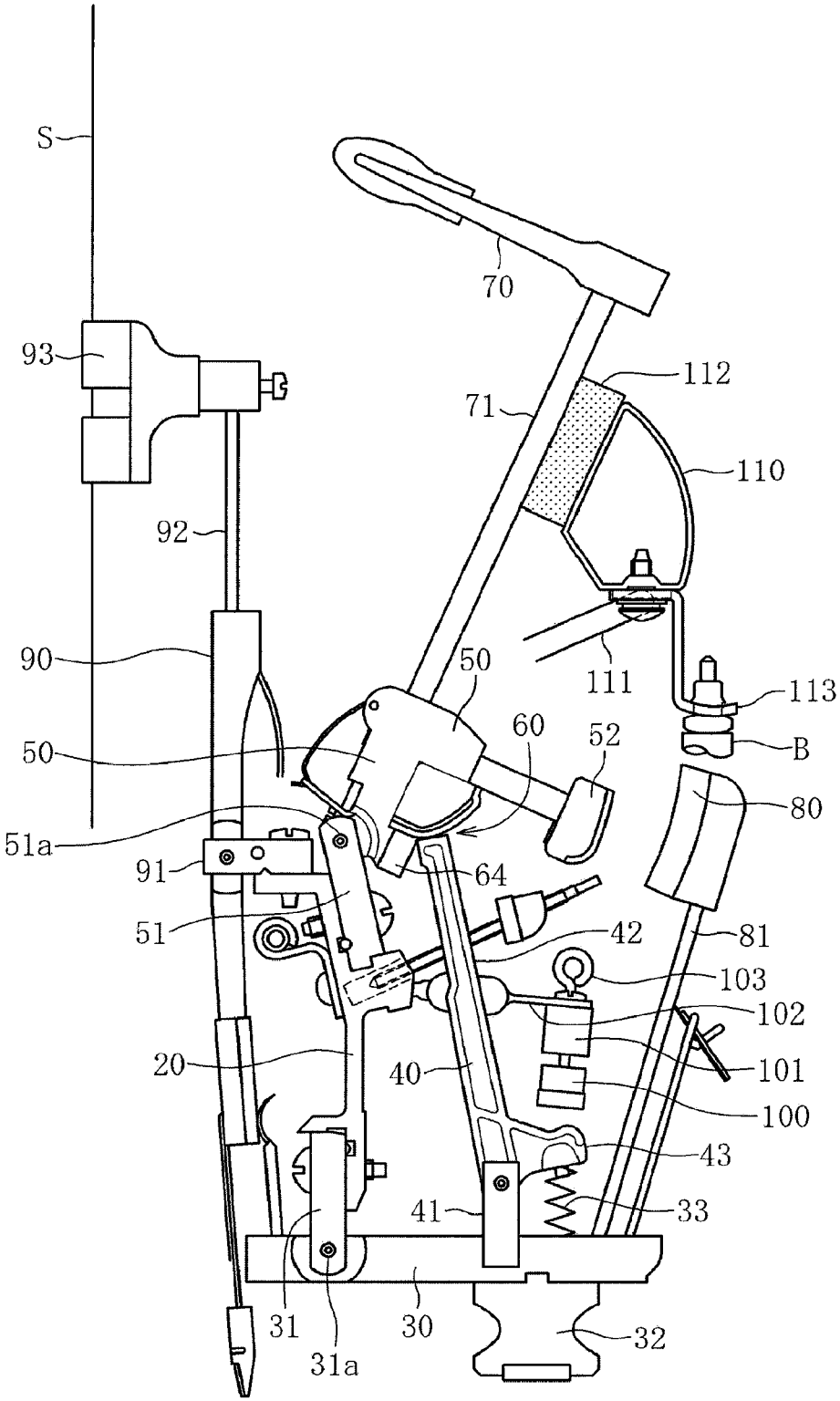
FIG. 1 is a longitudinal sectional side view of an upright piano type action according to an embodiment of the present invention, the action being in a state in which a key is not being depressed.

FIG. 1 is a side view of an upright piano type action according to the embodiment of the present invention. This figure indicates only parts of the action which serve a treble key.

The shown action is designed for an upright piano which is an acoustic piano. More specifically, the action is designed such that a hammer strikes a string S, so that vibrations of the string are conveyed to a soundboard to generate a musical tone. In a case where an action is designed for an upright-type electronic piano, the string S is replaced with a stopper such as a metal plate, with the hammer being replaced with a swing member that hits the stopper. In this case, more specifically, the electronic piano detects the velocity at which the swing member swings right before the hit, so that the electronic piano generates a musical tone having a tone volume corresponding to the detected velocity.

Hereafter, the present invention will be explained on the basis of an example of the shown action designed for an upright piano. The action has a common fundamental form which will be described below. That is, a center rail 20 extending in the direction of the width of the entire action is supported by brackets which are not shown on the both ends of the center rail 20. On the lower part of the center rail 20, a wippen flange 31 is provided for each key to support a wippen 30 via an axis 31*a* of the wippen flange 31 so that the wippen 30 can swing. The wippen 30 is supported by the wippen flange 31 at the proximity of the front end of the wippen 30 so that the wippen 30 can extend in the approximately horizontal direction. From the back undersurface of the wippen 30, a wippen heel 32 hangs down so that a capstan button which is not shown but is provided at the proximity of an end of the key will be raised by a depression of the key to lift the wippen heel 32 to swing the wippen 30 upward.

To a part situated immediately behind the center of the wippen 30, a jack 40 is coupled via a jack flange 41 so that the jack 40 can swing. The jack 40 is formed of a longer piece 42 and a shorter piece 43 to be shaped like a letter L when seen from the side. The longer piece 42 is inclined slightly frontward to extend upward to be in contact with a butt which will be described later. The shorter piece 43 extends backward from the lower end of the longer piece 42. A compression coil spring 33 is inserted between the shorter piece 43 and the wippen 30. The compression coil spring 33 lifts the shorter piece 43 upward to urge the jack 40 so that the jack 40 can swing.

On the upper part of the center rail 20, a butt flange 51 is provided for each key. The butt flange 51 supports a butt 50 via an axis 51*a* of the butt flange 51 so that the butt 50 can swing. From the upper part of the butt 50, a hammer shank 71 extends. To the tip of the hammer shank 71, a hammer 70 is coupled. To the back part of the butt 50, a catcher 52 for restricting recovery of the butt 50 from the hitting of the string is coupled. Behind the hammer shank 71, a hammer rail 110 is situated. The hammer rail 110 extends in the direction of the width of the entire action to be supported via a hammer rail hinge 111 by the brackets which are not shown on the both ends of the hammer rail 110 so that the hammer rail 110 can swing backward and forward. To a hammer rail's surface which faces the hammer shank 71, a hammer rail felt 112 is bonded, whereas an engaging piece 113 is mounted on the opposite side of the hammer rail 110. In a state where the key is not being depressed, the hammer rail 110 is placed in a back position as indicated in the figure, so that the hammer shank 71 is situated on the hammer rail felt 112 to be supported. From a pedal assembly which is not shown, a soft pedal lifting rod B extends upward so that the tip of the soft pedal lifting rod B is engaged with the engaging piece 113. When a player depresses a soft pedal, the soft pedal lifting rod B moves upward, so that the hammer rail 110 swings toward the string via the engaging piece 113. This aims to allow the hammer 70 to approach the string, so that the player is able to generate a musical tone in a reduced tone volume.

To the neighborhood of the back end of the wippen 30, a backcheck wire 81 which extends upward is coupled in order to provide a backcheck 80. The backcheck 80 has a function of restricting backward recovery of the hammer 70 caused by its repulsion from the hitting of the string. The top end of the center rail 20 supports a damper lever 90 provided for each key via a damper lever flange 91 extending frontward so that the damper lever 90 can swing. To the damper lever 90, a damper felt 93 is coupled through a damper wire 92 extending upward and the like. In accordance with the swing of the damper lever 90, the damper felt 93 leaves the string in response to a depression of the key, and comes into contact with the string in response to a release of the key to stop vibrations of the string.

Away backward from the central part of the center rail 20, a regulating rail 101 extends in the width direction of the entire action. The regulating rail 101 is connected to the center rail 20 through regulating brackets 102 spaced one another in the width direction of the entire action. To the regulating rail 101, a regulating screw 103 provided for each key is secured in the vertical direction. To the lower part of the regulating screw 103, a regulating button 100 is fastened. The regulating button 100 has a function of coming into contact with the shorter piece 43 of the jack 40 at some point during the rise of the jack 40 caused by a depression of the key to make the jack 40 swing backward.

The outline of the fundamental configuration of the action has been described above. Descriptions which are not directly related to the functions of the present invention will be omitted.

Figure 5:
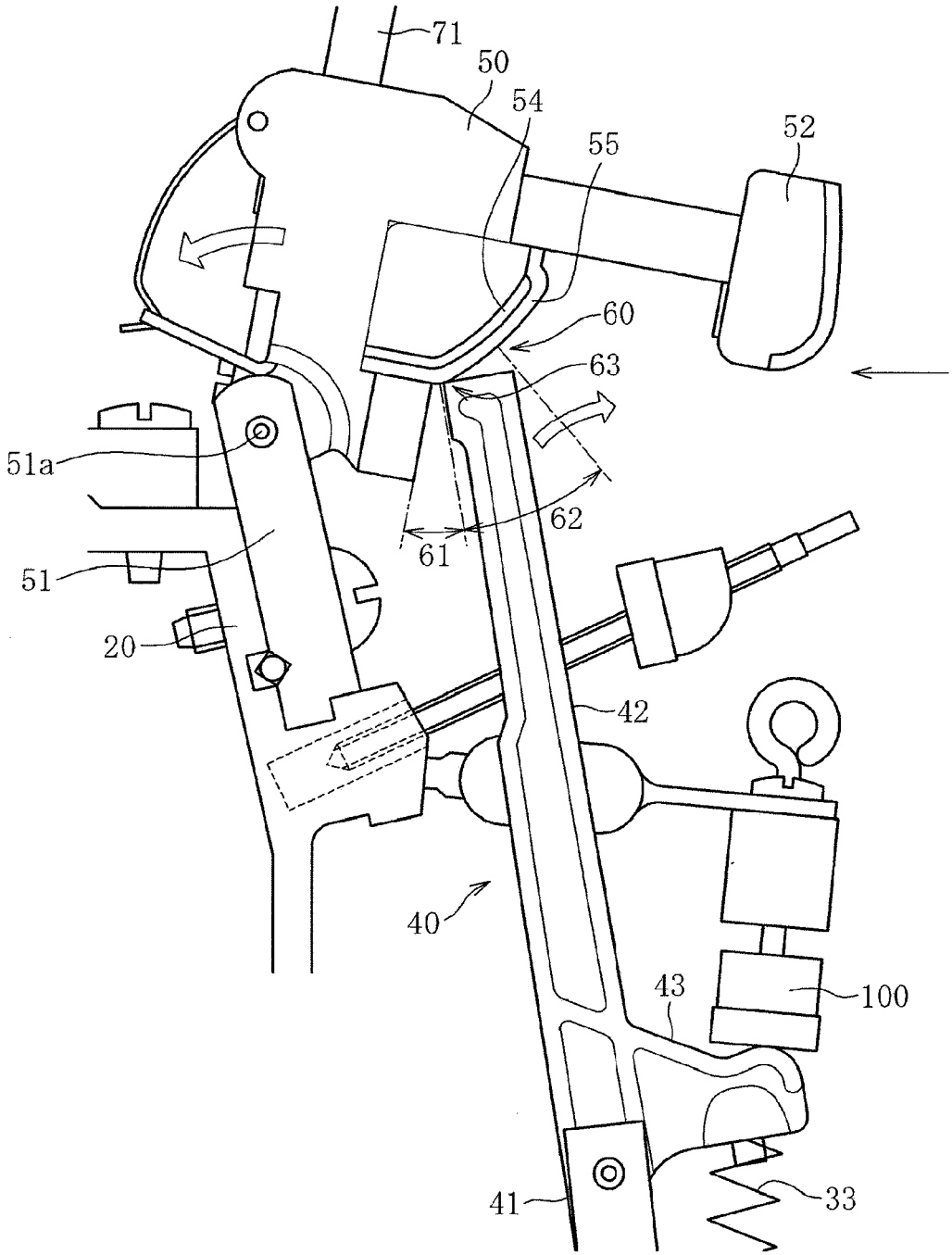
FIG. 5 is a side view of main components of the upright piano type action indicated in FIG. 1.

Features of the present invention will now be described. FIG. 5 is a side view indicative of main components of the action indicated in FIG. 1, with the butt 50 being centered.

The butt 50 indicated in the figure is designed such that areas which correspond to the under cloth, the under felt and the part to which the butt skin is directly adhered described in Description of the Related Art are covered with a cushioning layer 54 which seamlessly extends over the areas and a butt skin 55, so that the surface of the butt skin 55 serves as a surface 60 which is to be pushed up. The butt skin 55 may be made of buckskin of deerskin, as in conventional cases. Alternatively, the butt skin 55 may be made of artificial leather (for example, "ECSAINE" (registered trademark) of Toray Industries, Inc.). The cushioning layer 54 can be made of cloth, felt, or creep resistant polymeric cushioning material, for example. In order to provide the player clear sense of escapement which will be described later, however, the material of the cushioning layer 54 is preferable to be hard to some extent. Depending on the type, thickness and the like of the butt skin 55, however, the cushioning layer 54 can be omitted.

The surface 60 has a flat portion 61 situated forward and having a small angle of inclination with respect to the horizontal plane, and a slanting pressure receiving portion 62 situated backward and having a large angle of inclination with respect to the horizontal plane to form an escapement portion 63 having an obtuse angle between the flat portion 61 and the slanting pressure receiving portion 62. The escapement portion 63 is provided to correspond to the position of the tip of the jack 40 placed immediately after the start of swinging caused by the contact of the jack 40 with the regulating button 100 (the regulating member) in some point during the depression of the key.

The angle of inclination of the slanting pressure receiving portion 62 is determined such that when the key is depressed to a full stroke position so slowly that the hammer (the swinging member) will not hit the string, the jack 40 is to continue lifting the butt 50 whereas in a stage where the key starts returning from the full stroke position, the position at which the butt 50 is in contact with the jack 40 is to be kept with the butt 50 swinging backward.

Further, the butt 50 can be comprised as follows. The butt 50 is provided with a butt main body made of lumber, plastic, metal, or a combination of two or more thereof. The flat portion 61 and the slanting pressure receiving portion 62 provided on the surface of the butt 50 are formed in accordance with an outline of the butt main body, with the outline being covered with a butt skin 55.

The action indicated in the figures operates as follows. FIG. 1 indicates a state where the key is not being depressed. In this state, the wippen 30 is located at the lowest position, whereas the hammer shank 71 is inclined backward along with the hammer 70, so that the hammer shank 71 is supported by the hammer felt 112 of the hammer rail 110. The shorter piece 43 of the jack 40 is lifted by the spring 33, so that the jack 40 is situated just beneath the flat portion 61 and is in contact with a butt's dropping portion 64 which is adjacent to the flat portion 61 (FIG. 5).

Figure 2:
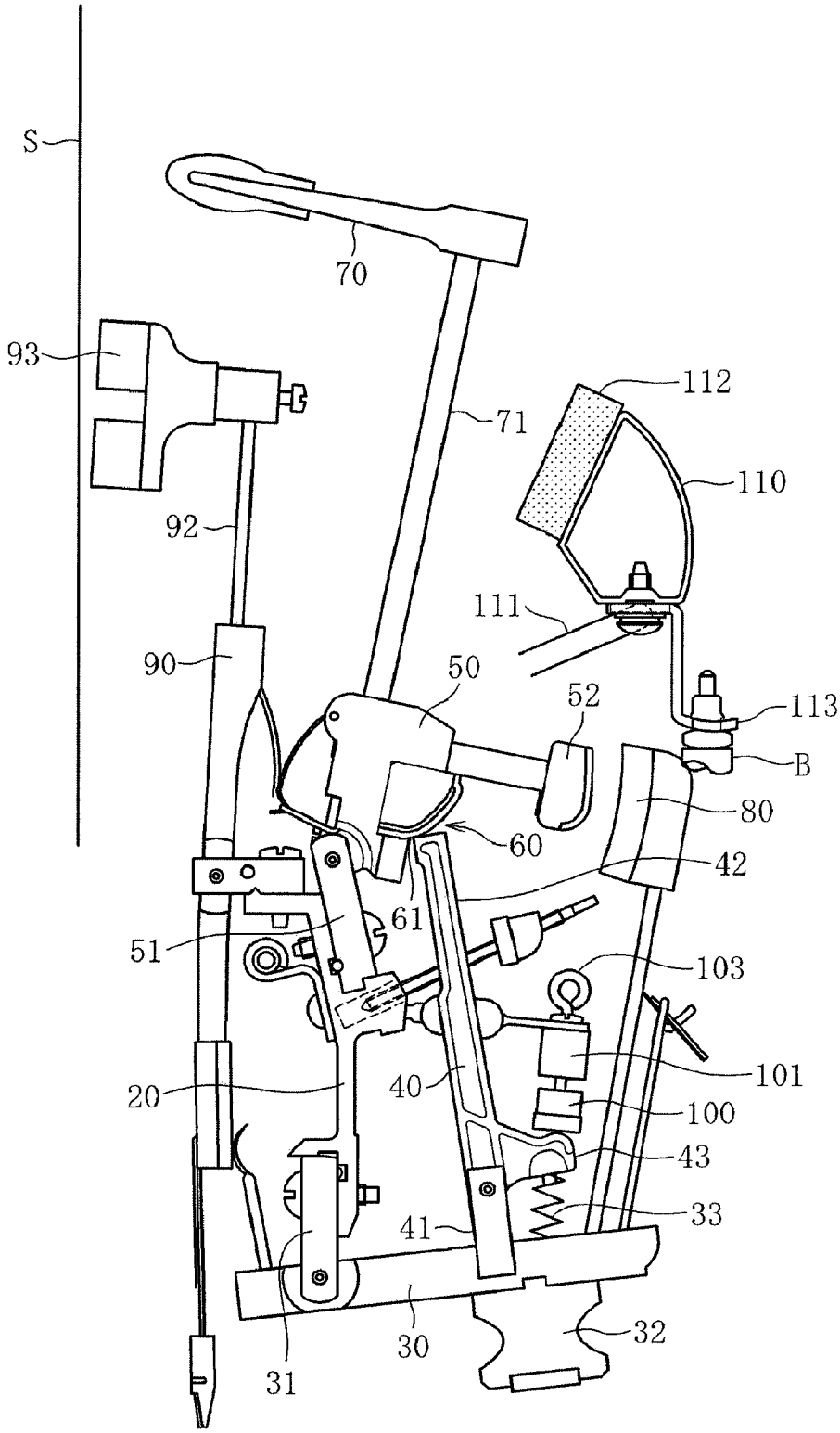
FIG. 2 is a longitudinal sectional side view of the upright piano type action indicated in FIG. 1, the action being in an initial stage of a depression of the key.

In a stage where the depression of the key has just started, as indicated in FIG. 2, the wippen 30 is raised, so that the jack 40 lifts the flat portion 61 to allow the butt 50 to swing forward to make the hammer 70 move forward. FIG. 5 is an enlarged view of this stage. As indicated in FIG. 5, the tip of the jack 40 reaches a point which is immediately in front of the escapement portion 63, with the shorter piece 43 of the jack 40 coming into contact with the regulating button 100 to start swinging slightly.

Figure 3:
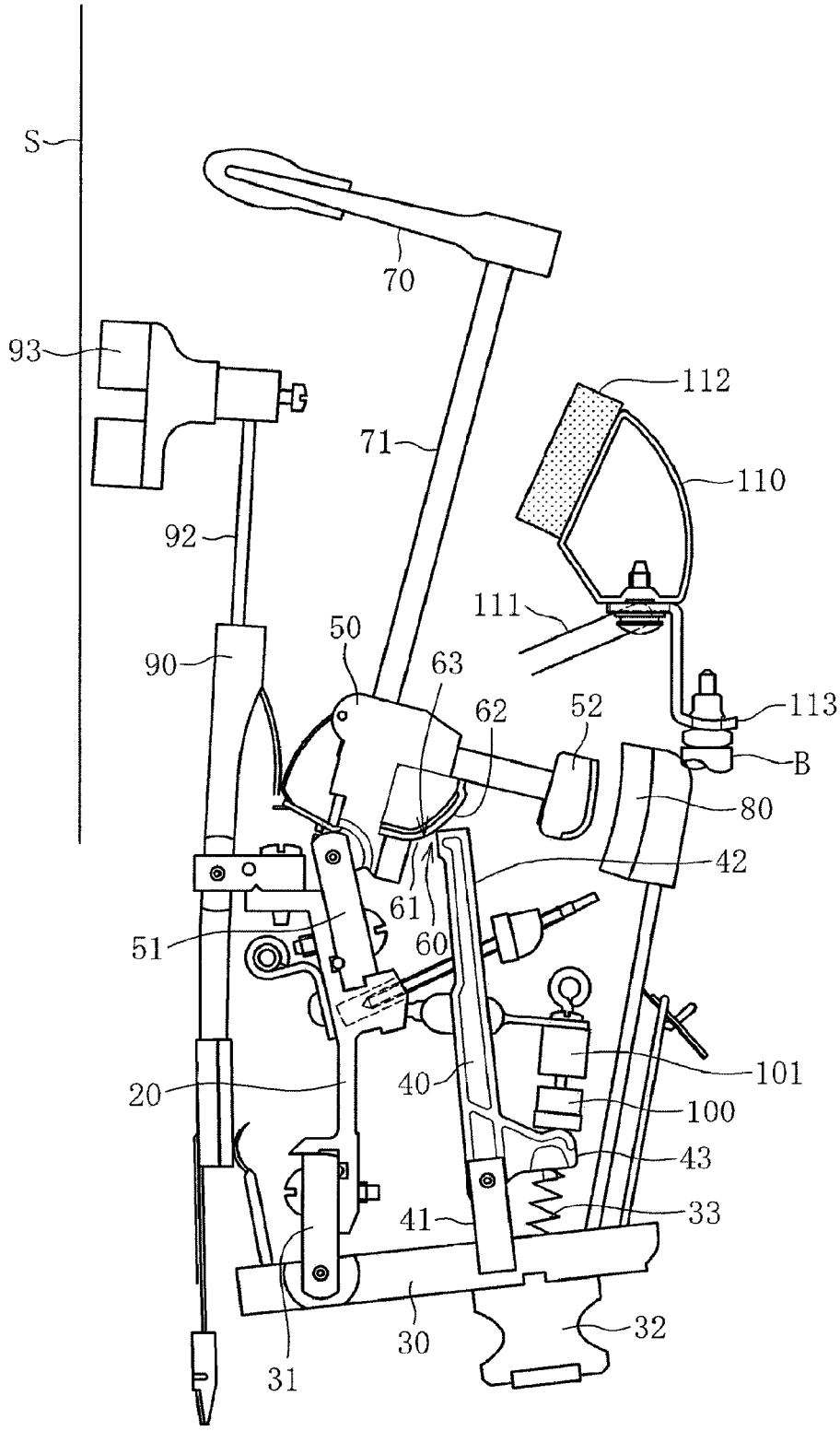
FIG. 3 is a longitudinal sectional side view of the upright piano type action indicated in FIG. 1, the action being in a stage in which the key is depressed further.

If the key is depressed further, as indicated in FIG. 3, because of the shorter piece 43 being raised in a state where the shorter piece 43 is kept in contact with the regulating button 100, the jack 40 swings backward to move beyond the escapement portion 63 to enter a state where the jack 40 is in contact with the slanting pressure receiving portion 62. At the instant when the jack 40 moves beyond the escapement portion 63, the strength with which the butt 50 is raised reduces sharply, so that the player perceives the sense of escapement. In particular, because the transition from the flat portion 61 to the slanting pressure receiving portion 62 takes place in a short period of time during which the jack 40 moves over the obtuse escapement portion 63, the player is able to recognize the vivid sense of escapement.

In order to provide a favorable sense of escapement and to secure favorable sense of touch, it is preferable that the obtuse angle (opening angle) formed in the escapement portion 63 by the flat portion 61 and the slanting pressure receiving portion 62 is from 135 to 145 degrees. If the angle is smaller than the above-described lowest degrees, the moment applied by the jack 40 to the slanting pressure receiving portion 62 to swing the butt 50 is small, so that the player will have difficulty in repeatedly depressing the key at deep positions. If the angle is larger than the above-described largest degrees, the jack 40 will not be able to return smoothly from the slanting pressure receiving portion 62 to the flat portion 61.

Figure 4:
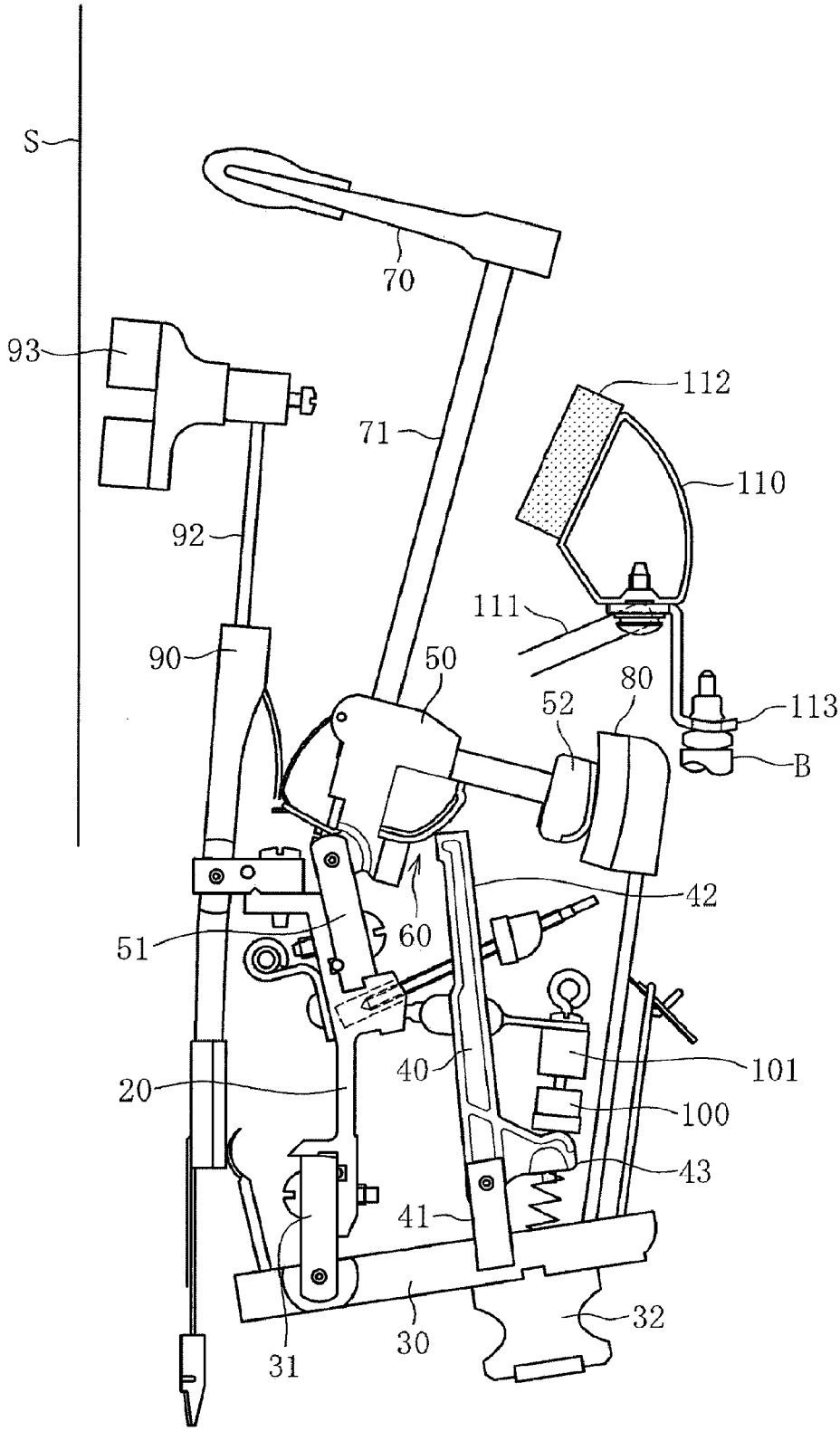
FIG. 4 is a longitudinal sectional side view of the upright piano type action indicated in FIG. 1, the action being in a stage in which the key is depressed even further.

When the key is depressed further, the jack 40 swings backward further, so that the jack leaves the slanting pressure receiving portion 62 of the butt 50 to enter a state of full stroke. In this state, the jack 40 has been raised and swung backward as far as possible. The hammer 70 enters a state of escapement where the inertia works, so that the hammer 70 hits the string. After the strike of the string, the hammer 70 recovers backward rapidly because of the repulsion of the string, so that the catcher 52 is received by the backcheck 80 as indicated in FIG. 4 to stop the recovery of the hammer 70.

If the key is returned slightly from the state of full stroke, the action returns to the state of FIG. 3 again, so that the jack 40 comes into contact with the slanting pressure receiving portion 62 of the butt 50. In a case where the key is depressed again from this state where the jack 40 is in contact with the slanting pressure receiving portion 62, the action of the present invention will operate as follows.

The velocity at which the jack 40 is raised increases with an increase in the strength of depression of the key. In the stage where the jack 40 is in contact with the flat portion 61, therefore, the velocity at which the butt 50 swings increases. As a result, after the transition of the jack 40 from the escapement portion 63 to the slanting pressure receiving portion 62, the time (distance) during which the jack 40 is in contact with the slanting pressure receiving portion 62 is short. Therefore, the hammer 70 enters the state of escapement in a stage of a shallow key-depression to hit the string to rebound backward, so that in as early as a stage which precedes the state of full stroke of the key-depression, the catcher 52 will be received by the backcheck 80. Immediately after the reception of the catcher 52 by the backcheck 80, the key-depression reaches the state of full stroke. As described above, because the catcher 52 is received by the backcheck 80 which is at a height situated before the state of full stroke, the amount of backward recovery of the hammer 70 is great. By the great amount of recovery of the hammer 70, the inclination of the slanting pressure receiving portion 62 becomes close to horizontal (from an upright state to a lying state). As a result, if the key is returned slightly from the state of full stroke, the jack 40 is easily returned to the lower part of the slanting pressure receiving portion 62. In this state, therefore, by a repeated depression of the key, the butt 50 is able to swing to hit the string S. As described above, the action relatively easily enables repeated depressions of the key with strong strengths.

In a case where the key is depressed with a small strength, on the other hand, the velocity at which the jack 40 is lifted is small, so that the time (distance) during which the jack 40 is in contact with the slanting pressure receiving portion 62 after the move of the jack 40 from the flat portion 61 over the escapement portion 63 to transfer to the slanting pressure receiving portion 62 is long. Therefore, the hammer 70 finally enters the state of escapement in a stage of a deep key-depression. As a result, when the hammer 70 rebounds backward caused by the hit of the string, the key-depression enters a state which is quite close to the state of full stroke. In this state, the catcher 52 is received by the backcheck 80. As described above, because the catcher 52 is received by the backcheck 80 which is at a height situated immediately before the state of full stroke, the amount of backward recovery of the hammer 70 is small. By the small amount of recovery of the hammer 70, the inclination of the slanting pressure receiving portion 62 becomes close to the vertical (an upright state). As a result, if the key is returned slightly from the state of full stroke, there is a possibility that the jack 40 moves down, sliding along the upright slanting pressure receiving portion 62 to be pushed backward. Even if the key is depressed again in the state where the jack 40 has been pushed backward, it is impossible to make the butt 50 swing to hit the string. However, the action of the present invention enables repeated depressions of the key as follows.

The slanting pressure receiving portion 62 is designed to have the angle of inclination which allows the jack 40 to keep lifting the butt 50 when the key has been depressed to the full stroke at a low velocity which will not allow the hammer 70 to hit the string (such a key-depression is referred to as a "static load key-depression"), and which keeps the position at which the slanting pressure receiving portion 62 is in contact with the jack 40 with the butt 50 swinging backward in a stage where the key starts returning from the full stroke position. By such a key-depression at such a very low velocity, the key-depression velocity and the velocity at which the butt swings are slower than those of the above-described weak key-depression. Therefore, the point at which the jack 40 comes into contact with the slanting pressure receiving portion 62 after the start of the recovery of the key from the full stroke is placed higher than those of any weak key-depressions which allow emission of a tone. The angle of inclination of the slanting pressure receiving portion 62 is determined such that the position at which the jack 40 is in contact with the slanting pressure receiving portion 62 is kept with the butt 50 swinging backward in the stage where the key starts returning in this state (the angle of inclination is referred to as "a contact keeping inclination angle". As a result, there is no possibility that the backward swinging of the upright slanting pressure receiving portion 62 causes the jack 40 to slide along the slanting pressure receiving portion 62 to swing backward. If a repeated key-depression took place in a state where the key is slightly returned from the full stroke, as a result, the butt 50 swings, without the sliding of the jack 40 along the slanting pressure receiving portion 62.

By any weak key-depression which results in the hitting of the string, the jack 40 is to be in contact with the slanting pressure receiving portion 62 at some point lower than the above-described highest position. Therefore, the jack 40 is in contact with the slanting pressure receiving portion 62 at a position where there is a lower risk of sliding than the above-described highest position, ensuring the next hitting of the string by a key-depression at a position where the key is slightly returned. Therefore, the action of the present invention enables repeated weak depressions of the key, facilitating player's repeated key-depressions which are depressed at deep positions.

Figure 6:
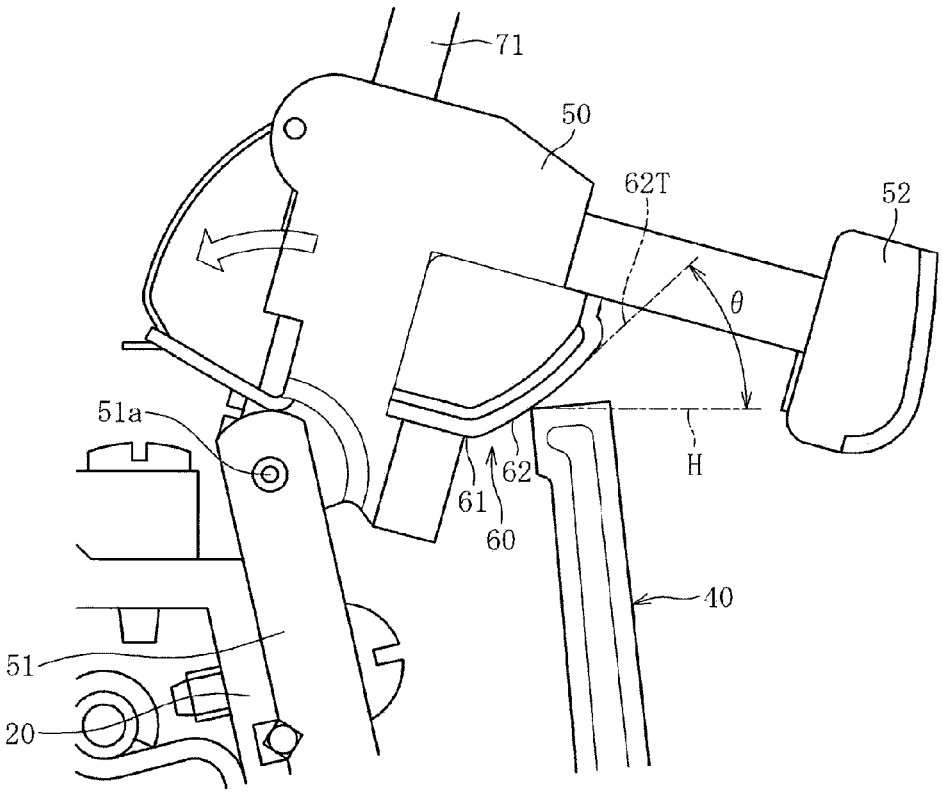
FIG. 6 is an explanatory drawing indicative of a configuration of the main components of the upright piano type action indicated in FIG. 1.

The above-described contact keeping inclination angle can be defined, as indicated in FIG. 6, as an inclination angle θ situated at the position where the jack 40 is in contact with the slanting pressure receiving portion 62 by the full-stroke static load key-depression and formed between a tangent plane 62T of the slanting pressure receiving portion 62 and a horizontal plane H. In this case, it is preferable that the inclination angle θ is from 15 to 33 degrees. If the inclination angle θ is smaller than the above-described lowest degrees, the jack 40 will not be able to return smoothly from the slanting pressure receiving portion 62 to the flat portion 61. If the angle θ is larger than the above-described largest degrees, the rate at which the jack 40 applies moment to the slanting pressure receiving portion 62 (the moment applied by the jack 40 to the slanting pressure receiving portion 62 when the key slightly returned from the full stroke is depressed) is reduced to make it difficult for the player to repeatedly depress the key at deep positions.

Figure 7:
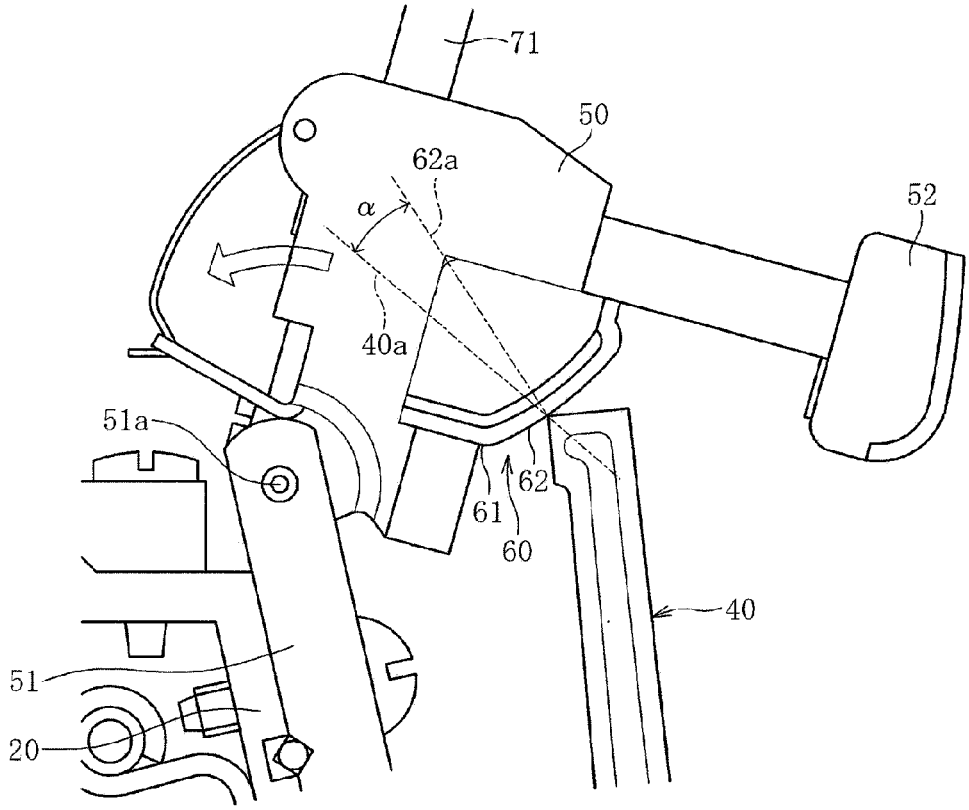
FIG. 7 is an explanatory drawing indicative of a configuration of the main components of the upright piano type action indicated in FIG. 1.

The contact keeping inclination angle can be also defined, as indicated in FIG. 7, as a crossing angle α situated at the position where the jack 40 is in contact with the slanting pressure receiving portion 62 by the full-stroke static load key-depression and formed by a bisector 40*a* of a vertical plane of the tip of the jack 40 and a normal 62*a* of the slanting pressure receiving portion 62. In this case, it is preferable that the crossing angle α is from 12 to 30 degrees. If the crossing angle α is smaller than the above-described lowest degrees, the rate at which the jack 40 applies moment to the slanting pressure receiving portion 62 is reduced to make it difficult for the player to repeatedly depress the key at deep positions. If the angle α is larger than the above-described largest degrees, the jack 40 will not be able to return smoothly from the slanting pressure receiving portion 62 to the flat portion 61. In this state, an angle formed by the jack 40 with respect to the vertical plane in the swinging direction is from 0 to 20 degrees.

Figure 8:
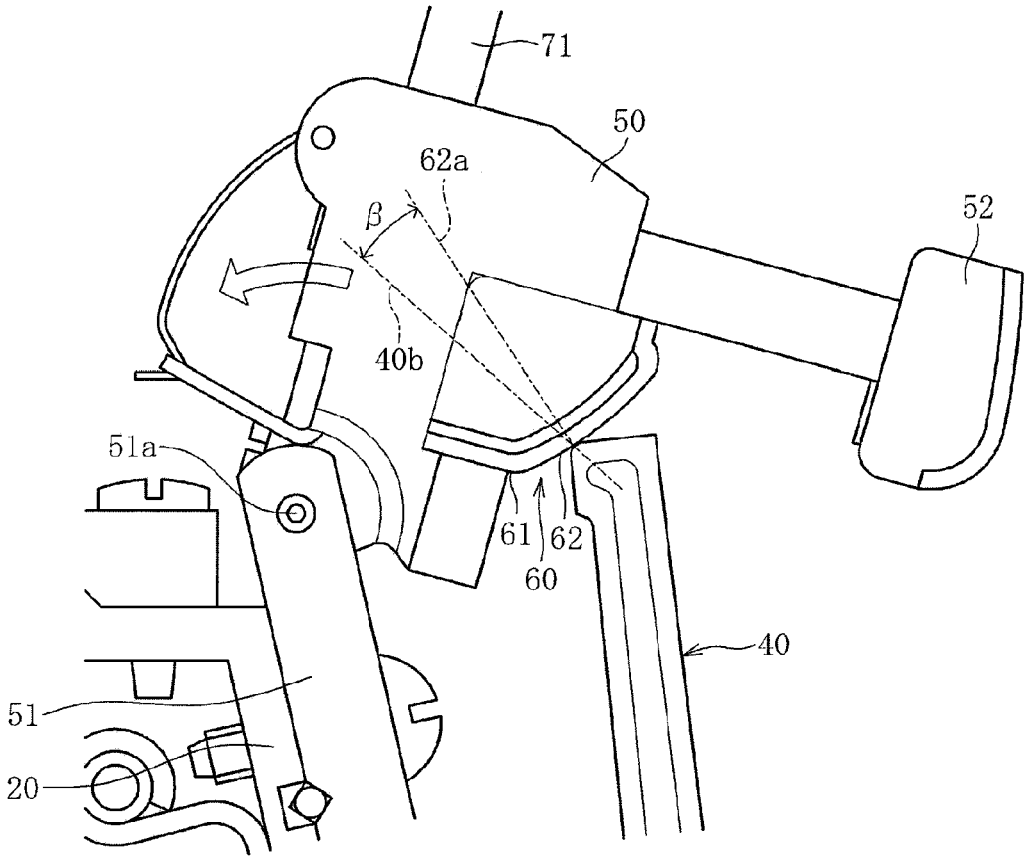
FIG. 8 is an explanatory drawing indicative of a configuration of the main components of the upright piano type action indicated in FIG. 1.

The contact keeping inclination angle can be also defined, as indicated in FIG. 8, as a crossing angle β situated at the position where the jack 40 is in contact with the slanting pressure receiving portion 62 by the full-stroke static load key-depression and formed, in a case of the jack 40 having a round tip, by a normal 40*b* of the round surface of the tip of the jack 40 and the normal 62*a* of the slanting pressure receiving portion 62. In this case, it is preferable that the crossing angle β is from 12 to 30 degrees. If the crossing angle β is smaller than the above-described lowest degrees, the rate at which the jack 40 applies moment to the slanting pressure receiving portion 62 is reduced to make it difficult for the player to repeatedly depress the key at deep positions. If the angle β is larger than the above-described largest degrees, the jack 40 will not be able to return smoothly from the slanting pressure receiving portion 62 to the flat portion 61. In this case as well, the angle formed by the jack 40 with respect to the vertical plane in the swinging direction is from 0 to 20 degrees.

The above description was made for the embodiment of the action of an upright piano. In a case where the action is applied to an upright-type electronic piano, however, the string S is replaced with a stopper member such as a metal plate. Therefore, the "string" used in the above description is replaced with the stopper member, whereas the "hitting of the string" is replaced with hitting of the stopper member. For the hammer, the felt may not be used in order to hit a string, but resin, rubber or the like which is able to hit the stopper member that may be used. Because any vibration caused by strings will not be generated on the upright-type electronic piano, the above-described damper mechanism and the like are not necessary.

The present invention is not limited to the above-described embodiment, but can be variously modified without departing from the spirit and scope of the invention.

What is claimed is:

1. An upright piano type action comprising:

a jack moving in response to a depression and a release of a key;

a butt having a surface pushed up by the jack in response to the depression of the key; and a swinging member extending from the butt and swinging forward and backward in response to the depression and the release of the key respectively to perform a hitting activity; wherein the surface of the butt is provided with a flat portion which is situated forward and has a small inclination angle with respect to a horizontal plane, and a slanting pressure receiving portion which is situated backward and has a large inclination angle with respect to the horizontal plane as areas pushed up by the jack, so that the flat portion and the slanting pressure receiving portion form an escapement portion having an obtuse angle between the flat portion and the slanting pressure receiving portion;

the escapement portion is provided to correspond to a position of the jack placed immediately after start of swinging caused by contact of the jack with a regulating member in some point during the depression of the key; and the angle of inclination of the slanting pressure receiving portion is determined such that when the key is depressed to a full stroke position so slowly that the swinging member will not perform the hitting activity, the jack is to continue pushing up the butt whereas in a stage where the key starts returning from the full stroke position, a position at which the butt is in contact with the jack is to be kept with the butt swinging backward.

2. The upright piano type action according to claim 1, wherein the obtuse angle of the escapement portion is from 135 to 145 degrees.

3. The upright piano type action according to claim 1, wherein an inclination angle which is situated at a position where the jack is contact with the slanting pressure receiving portion by such a slow full-stroke key-depression that the swinging member will not perform the hitting activity, and is formed between a tangent plane of the slanting pressure receiving portion and the horizontal plane is from 15 to 33 degrees.

4. The upright piano type action according to claim 1, wherein a crossing angle which is situated at a position where the jack is in contact with the slanting pressure receiving portion by such a slow full-stroke key-depression that the swinging member will not perform the hitting activity, and is formed by a bisector of a vertical plane of a tip of the jack and a normal of the slanting pressure receiving portion is from 12 to 30 degrees.

5. The upright piano type action according to claim 1, wherein a crossing angle which is situated at a position where the jack is in contact with the slanting pressure receiving portion by such a slow full-stroke key-depression that the swinging member will not perform the hitting activity, and is formed by a normal of a round surface of a tip of the jack and a normal of the slanting pressure receiving portion is from 12 to 30 degrees.

6. The upright piano type action according to claim 1, wherein the butt is provided with a butt main body made of lumber, plastic, metal, or a combination of two or more thereof; and the flat portion and the slanting pressure receiving portion provided on the surface of the butt are formed in accordance with an outline of the butt main body, with the outline being covered with a butt skin.

* * * * *